US007187127B2

(12) United States Patent
Kim et al.

(10) Patent No.: US 7,187,127 B2
(45) Date of Patent: Mar. 6, 2007

(54) PLASMA DISPLAY PANEL HAVING EXOTHERMAL INHIBITION LAYER

(75) Inventors: Se-Jong Kim, Suwon-si (KR); Seok-Gyun Woo, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/895,384

(22) Filed: Jul. 21, 2004

(65) Prior Publication Data

US 2005/0023981 A1 Feb. 3, 2005

(30) Foreign Application Priority Data

Jul. 30, 2003 (KR) ..... 10-2003-0052600

(51) Int. Cl.
*H01J 17/49* (2006.01)
*G09G 3/28* (2006.01)

(52) U.S. Cl. ..... 313/587; 313/582; 313/586; 345/60

(58) Field of Classification Search ..... 313/586, 313/587

See application file for complete search history.

(56) References Cited

U.S. PATENT DOCUMENTS 5,703,437 A * 12/1997 Komaki ..... 313/587
5,714,840 A * 2/1998 Tanabe et al. ..... 313/581
2002/0036466 A1* 3/2002 Tanaka et al. ..... 313/586
2002/0163304 A1* 11/2002 Akiba ..... 313/584
2003/0201717 A1* 10/2003 Hibino et al. ..... 313/586

FOREIGN PATENT DOCUMENTS

KR 1020010019794 A 3/2001

* cited by examiner

*Primary Examiner*—Nimeshkumar D. Patel
*Assistant Examiner*—Peter Macchiarolo
(74) *Attorney, Agent, or Firm*—H.C. Park Associates, PLC

(57) ABSTRACT

A plasma display panel comprising a first substrate and a second substrate with a first dielectric layer formed on a surface of the first substrate and a second dielectric layer formed on a surface of the second substrate. A plurality of barrier ribs are interposed between the first and second substrates to provide a discharge space and a non-discharge space. A protection layer comprising MgO is formed on an area of the second dielectric layer over the discharge space, and an exothermal inhibition layer is formed on an area of the second dielectric layer over the non-discharge space. The protection layer may also be comprised of MgO and an exothermal inhibition material.

14 Claims, 4 Drawing Sheets

PLASMA DISPLAY PANEL HAVING EXOTHERMAL INHIBITION LAYER

This application claims the benefit of Korean Patent Application No. 2003-52600, filed on Jul. 30, 2003, which is hereby incorporated by reference for all purposes as if fully set forth herein.

BACKGROUND OF THE INVENTION

1. Field of the Invention

The present invention relates to a plasma display panel, and more particularly, to a plasma display panel capable of reducing the exothermal phenomenon in the panel.

2. Discussion of the Related Art

A plasma display panel (PDP) is a flat display device using a gas-discharge phenomenon to display images. A discharge is generated when a potential greater than a certain level is applied to two electrodes separated from each other under a gas atmosphere in a non-vacuum state.

The PDP comprises an upper substrate and a lower substrate. Sustain electrodes (or X electrodes) and scan electrodes (or Y electrodes) are formed on the upper substrate, and address electrodes are formed on the lower substrate. Barrier ribs are formed between the upper and the lower substrates to provide a space corresponding to a discharge cell. Dielectric layers are formed on both the upper substrate and the lower substrate.

Now, the structure of the conventional PDP is explained with reference to FIG. 1, which shows a plan view of a conventional PDP.

As shown in FIG. 1, a plurality of barrier ribs 3 are disposed between the upper and lower substrates 1 with a certain distance therebetween. Address electrodes 5 for applying an addressing signal are formed between the barrier ribs 3 on the lower substrate of the substrates 1.

Scan electrodes 7 and sustain electrodes 9 are formed perpendicularly to the address electrodes 5 at certain intervals to form scan and sustain electrode pairs for each discharge cell.

Substrates 1 comprise a light emitting area 11 and a non-light emitting area 13. A plurality of dummy scan electrodes 15 and dummy sustain electrodes 17 are formed in the non-light emitting area 13.

In the conventional PDP as explained above, a driving voltage is applied via address electrodes 5 and scan electrodes 7 to generate an address discharge between these electrodes and to provide a wall charge on the dielectric layer (not shown).

Cells selected by the address discharge generate a sustain discharge between both electrodes 7 and 9 due to the alternating signal provided to the scan electrode 7 and the sustain electrode 9.

Accordingly, the discharge gas present in the discharge space is excited and transformed, thereby generating an ultraviolet ray. The ultraviolet ray excites the phosphor to generate a visible light, which realizes a certain image on the PDP.

The PDP generates heat due to the internal panel discharges as well as heat generation from the circuits. As the heat generated from the discharge tends to propagate to the entire area of the panel due to the conductive characteristic of the solid material, the panel properties are deteriorated.

SUMMARY OF THE INVENTION

Accordingly, the present invention is directed to a PDP that substantially obviates one or more of the problems due to limitations and disadvantages of the related art.

The present invention provides a plasma display panel capable of reducing or rapidly removing internally generated heat.

Additional features of the invention will be set forth in the description which follows, and in part will be apparent from the description, or may be learned by practice of the invention.

An aspect of the present invention discloses a PDP comprising a first substrate and a second substrate with a first dielectric layer formed on a surface of the first substrate and a second dielectric layer formed on a surface of the second substrate. A plurality of barrier ribs are interposed between the first and second substrates to provide a discharge space and a non-discharge space. A protection layer comprising MgO is formed on an area of the second dielectric layer over the discharge space, and an exothermal inhibition layer is formed on an area of the second dielectric layer over the non-discharge space.

The present invention also discloses a PDP comprising a first substrate with a first dielectric layer formed on a surface of the first substrate and a second substrate with a second dielectric layer formed on a surface of the second substrate. A plurality of barrier ribs are interposed between the first substrate and the second substrate, and a protection layer comprising MgO and an exothermal inhibition material is formed on the second dielectric layer.

The present invention also discloses a method of manufacturing a PDP comprising the steps of forming a first dielectric layer on a first substrate, forming a second dielectric layer on a second substrate, and forming a plurality of barrier ribs on the first dielectric layer to provide a discharge space and a non-discharge space. A protection layer, comprising MgO, is formed on an area of the second dielectric layer over the discharge space. An exothermal inhibition layer is formed on an area of the second dielectric layer over the non-discharge space.

The present invention also discloses an exothermal inhibition layer for a plasma display panel, comprising an exothermal inhibition material that has an absolute value of $\Delta Hc$ ("$|\Delta Hc|$") in the range of 0.3 to 2.5 kcal/° C., where $|\Delta Hc|$ is a difference between a thermal conductivity of the exothermal inhibition material and a thermal conductivity of MgO.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate an embodiment of the invention and together with the description serve to explain the principles of the invention.

DETAILED DESCRIPTION OF THE PREFERRED EMBODIMENTS

Reference will now be made in detail to an embodiment of the present invention, example of which is illustrated in the accompanying drawings.

The present invention utilizes an exothermal inhibition material to remove internally generated heat from a PDP. The exothermal inhibition material has a thermal conductivity different from the MgO of the protection layer. A discharge area may be coated with the MgO protection layer, and a non-discharge area may be coated with the exothermal inhibition layer.

Alternatively, the discharge area may be coated with a mixture of MgO and the exothermal inhibition material. In this case, the exothermal inhibition material may be in the form of a cluster. The term "discharge area" means an area on a dielectric layer contacting with the discharge space, which is created between the upper and lower substrates by the barrier ribs. The term "non-discharge area" means the area on the dielectric layer contacting with the space above the barrier ribs.

The exothermal inhibition material may have a thermal conductivity (Hc) difference from MgO of 0.3 to 2.5 kcal/° C., preferably 1.5 to 2.5 kcal/° C., where Hc is the absolute value shown in the following Formula:

$$|\Delta Hc| = |\text{thermal conductivity of exothermal inhibition material} - \text{thermal conductivity of MgO}|$$

The exothermal inhibition material includes low thermal conductive material such as $SiO_2$, $ZrSiO_4$, and $ZrO_2$ (i.e., having thermal conductivity lower than that of MgO), or an Al compound such as $Al_2O_3$ for the high thermal conductivity material (i.e., having thermal conductivity higher than that of MgO). When the exothermal inhibition material is a low thermal conductive material, the PDP temperature may be lowered, and when high thermal conductive material is used, the internally generated heat may be rapidly removed, thereby stabilizing the PDP and discharge gas.

The exothermal inhibition layer composed of the exothermal inhibition material is preferably, but not necessarily, transparent since visible light can be transmitted therethrough.

Figure 1:
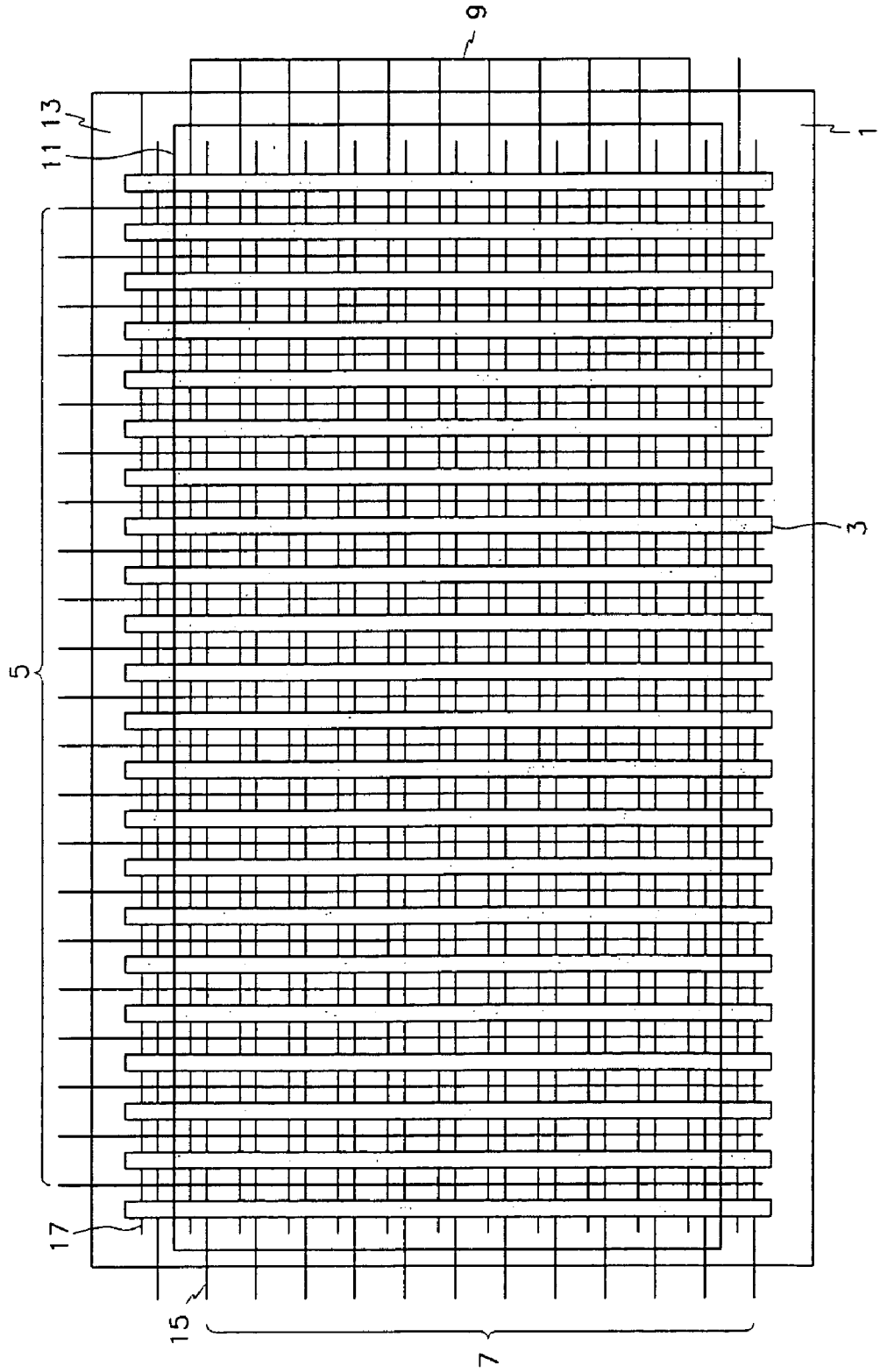
PRIOR ART Fig.1
FIG. 1 shows a plan view of a conventional PDP.
Figure 2:
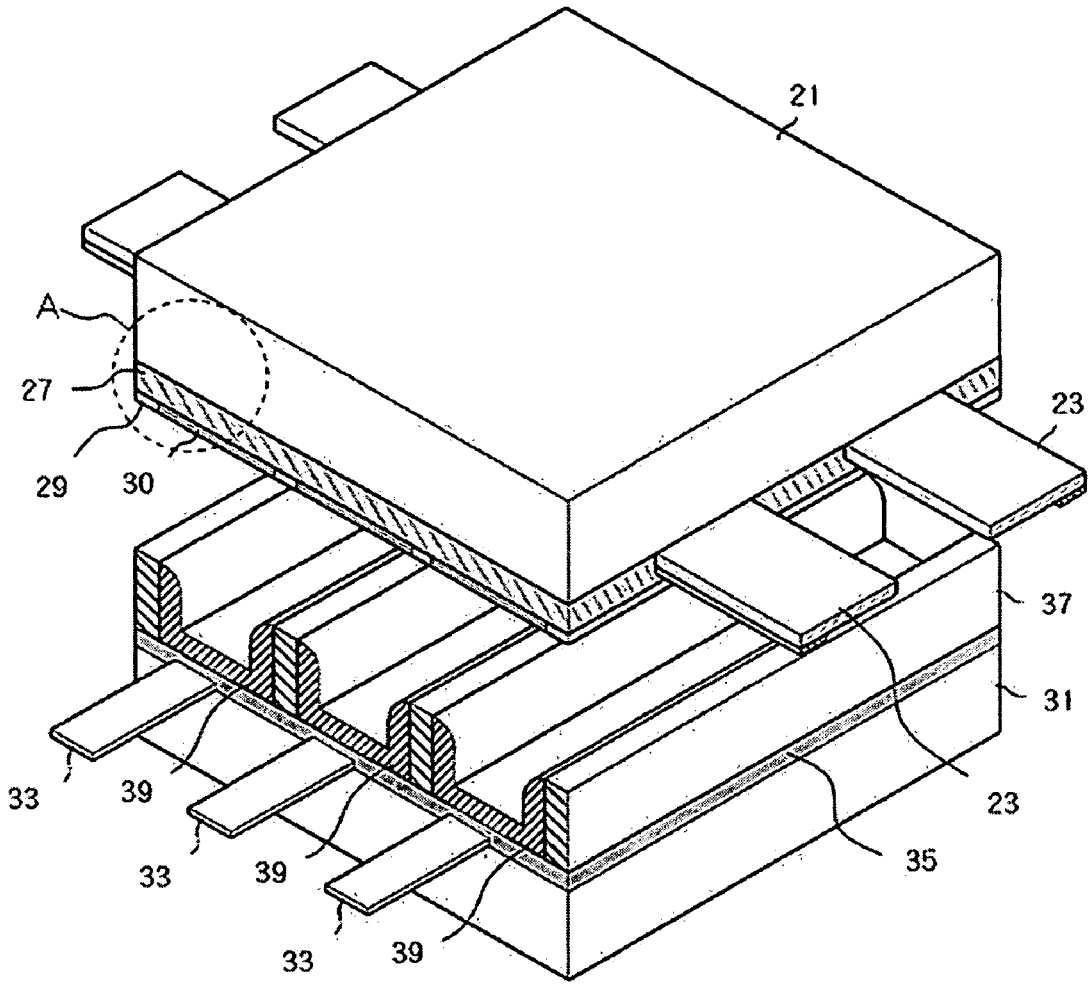
FIG. 2 shows a cross-sectional view of the structure of a PDP according to an exemplary embodiment of the present invention.
Figure 3:
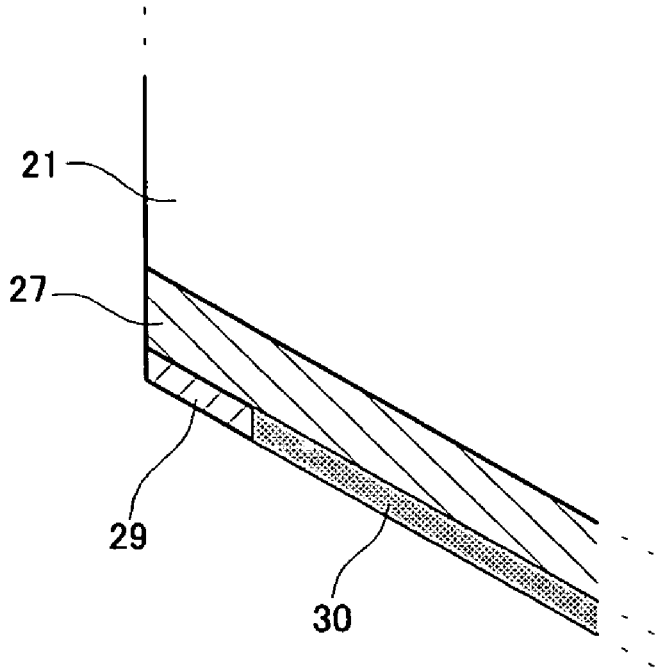
FIG. 3 is a close up perspective view of the PDP of FIG. 2.

FIG. 2 shows a PDP according to an exemplary embodiment of the present invention, in which a MgO protection layer is formed on the discharge area and the exothermal inhibition layer, comprised of exothermal inhibition material, is formed on the non-discharge area. FIG. 3 is a close up perspective view of region A of the PDP of FIG. 2. Referring to FIG. 2 and FIG. 3, the PDP of this exemplary embodiment comprises a first, or lower, substrate 31 and a second, or upper, substrate 21 that are parallel to each other with a certain distance therebetween. A dielectric layer 35, which covers the address electrodes 33, is coated on the lower substrate 31 surface facing the upper substrate.

A plurality of barrier ribs 37 are formed to a certain height on the dielectric layer 35 to provide the discharge space. A phosphor layer 39 is formed on the area of the dielectric layer 35 and the sides of the barrier ribs 37 contacting with the discharge space.

Figure 4:
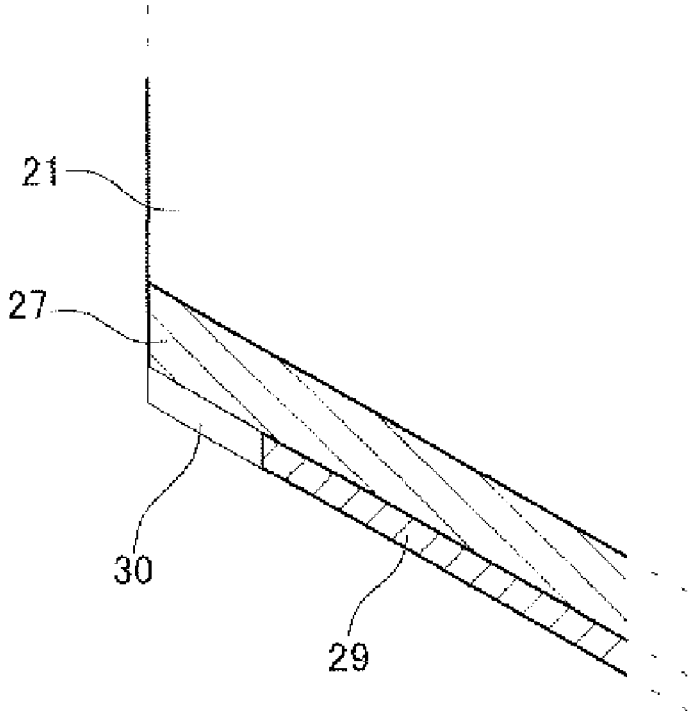
FIG. 4 shows a cross-sectional view of the structure of a PDP according to an exemplary embodiment of the present invention.

A plurality of discharge sustain electrodes 23, arranged perpendicularly to the address electrodes 33, are formed on the upper substrate 21 surface facing the lower substrate 31. A dielectric layer 27, formed on the upper substrate 21, covers the discharge sustain electrodes 23. A MgO protection layer 30 is coated on the discharge area of the dielectric layer 27, and an exothermal inhibition layer 29 is formed on the non-discharge area of the dielectric layer 27. Alternatively, as FIG. 4 shows, the exothermal inhibition layer 29 may be formed on the discharge area of the dielectric layer 27, and the MgO protection layer 30 may be coated on the non-discharge area of the dielectric layer 27.

As the method of preparing the above-mentioned PDP is well appreciated by one having ordinary skill in the art, a detailed description relating thereto is omitted. However, a process of preparing an exothermal inhibition layer and a process of preparing a MgO protection layer which may be added with an exothermal inhibition layer are described below in detail.

The exothermal inhibition layer may be obtained by a deposition method using plasma, such as an electron beam deposition technique, an ion plating technique, or a magnetron sputtering technique. That is, MgO and the exothermal inhibition material (either low thermal conductive material or high thermal conductive material) are separately prepared and deposited using a mask in the deposition chamber to provide a protection layer and an exothermal inhibition layer.

On the other hand, the protection layer may be prepared by mixing MgO with exothermal inhibition material and depositing it with a plasma deposition process. Alternatively, MgO may be deposited and then the exothermal inhibition material is deposited with simultaneous injection of $O_2$ to obtain a protection layer having the impurity of the exothermal inhibition material in the MgO. The exothermal inhibition material may be in an amount of 2 to 40 mol % with respect to the amount of MgO.

The following examples illustrate exemplary embodiments of the present invention in further detail. However, it is to be understood that the present invention is not limited by these examples.

EXAMPLE 1

A discharge sustain electrode was fabricated in a stripe shape in accordance with a conventional method by applying an indium tin oxide conductive material on an upper substrate of soda lime glass.

Then, a front surface of the upper substrate was coated with a lead-based glass paste and sintered to provide a dielectric layer.

A protection layer comprising MgO was formed on the discharge area of the dielectric layer by a sputtering method using a mask. Subsequently, a $SiO_2$ exothermal inhibition layer having thermal conductivity of about 1 kcal/° C. was formed in the non-discharge area by a conventional sputtering method using a mask.

The PDP was fabricated according to conventional methods using the upper substrate described above.

EXAMPLE 2

A discharge sustain electrode was fabricated in a stripe shape in accordance with a conventional method by applying an indium tin oxide conductive material on an upper substrate of soda lime glass.

Then, a front surface of the upper substrate was coated with a lead-based glass paste and sintered to provide a dielectric layer.

Next, a protection layer having an impurity of $Al_2O_3$ in MgO was formed by depositing MgO and then further depositing $Al_2O_3$ on the discharge area, in the amount of 10 mol % with respect to the amount of MgO, while simultaneously injecting $O_2$.

The PDP was fabricated by conventional methods using the upper substrate described above.

EXAMPLE 3

A discharge sustain electrode was fabricated in a stripe shape in accordance with a conventional method by applying an indium tin oxide conductive material on an upper substrate of soda lime glass.

Then, a front surface of the upper substrate was coated with a lead-based glass paste and sintered to provide a dielectric layer.

Next, a protection layer having an impurity of $ZrSiO_4$ in MgO was formed by depositing MgO and then further depositing $ZrSiO_4$ on the discharge area, in the amount of 10 mol % with respect to the amount of MgO, while simultaneously injecting $O_2$.

The PDP was fabricated by conventional methods using the manufactured upper substrate.

EXAMPLE 4

A discharge sustain electrode was fabricated in a stripe shape in accordance with a conventional method by applying an indium tin oxide conductive material on an upper substrate of soda lime glass.

Then, a front surface of the upper substrate was coated with a lead-based glass paste and sintered to provide a dielectric layer.

Next, a protection layer having an impurity of $ZrO_2$ in MgO was formed by depositing MgO and then further depositing $ZrO_2$ on the discharge area, in the amount of 10 mol % with respect to the amount of MgO, while simultaneously injecting $O_2$.

The PDP was fabricated by conventional methods using the manufactured upper substrate.

COMPARATIVE EXAMPLE 1

A discharge sustain electrode was fabricated in a stripe shape in accordance with a conventional method by applying an indium tin oxide conductive material on an upper substrate of soda lime glass.

Then, a front surface of the upper substrate was coated with a lead-based glass paste and sintered to provide a dielectric layer.

Next, a MgO protection layer was formed on the dielectric layer by a sputtering method.

The PDP was fabricated by conventional methods using the manufactured upper substrate.

The low thermal conductive materials, such as $SiO_2$, $ZrSiO_4$, and $ZrO_2$, may lower the PDP's temperature. When a high thermal conductive material, such as $Al_2O_3$, is used, the internally generated heat may be rapidly removed so that the PDP and discharge gas become more stable.

Moreover, $SiO_2$ without crystalline structure, may lower the PDP protection layer's roughness, and the sputtering resistance of $ZrSiO_4$ and $ZrO_2SiO_2$ may extend the PDP protection layer's life span.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising:

a first substrate and a second substrate;

a first dielectric layer formed on a surface of the first substrate;

a second dielectric layer formed on a surface of the second substrate;

a plurality of barrier ribs interposed between the first substrate and the second substrate to provide a discharge space and a non-discharge space;

a protection layer comprising MgO formed on an area of the second dielectric layer over the discharge space; and an exothermal inhibition layer formed on an area of the second dielectric layer over the non-discharge space only, wherein the second dielectric layer is arranged between the second substrate and the exothermal inhibition layer.

2. The PDP of claim 1, wherein the exothermal inhibition layer comprises an exothermal inhibition material having an absolute value of ΔHc ("|ΔHc|") in the range of 0.3 to 2.5 kcal/° C. , where |ΔHc| is a difference between a thermal conductivity of the exothermal inhibition material and a thermal conductivity of MgO.

3. The PDP of claim 2, wherein |ΔHc| is in the range of 1.5 to 2.5 kcal/° C.

4. The PDP of claim 2, wherein the exothermal inhibition layer comprises $SiO_2$, $ZrSiO_4$, $ZrO_2$, or an Al compound.

5. A plasma display panel, (PDP) comprising:

a first substrate and a second substrate;

a first dielectric layer formed on a surface of the first substrate;

a second dielectric layer formed on a surface of the second substrate;

a plurality of barrier ribs interposed between the first substrate and the second substrate to provide a discharge space and a non-discharge space; and protection layer comprising MgO and an exothermal inhibition material formed on the second dielectric layer, the exothermal inhibition material being arranged on an area of the second dielectric layer over the discharge space only, wherein the second dielectric layer is arranged between the second substrate and the exothermal inhibition material.

6. The PDP of claim 5, wherein the exothermal inhibition material has an absolute value of ΔHc ("ΔHc|") in the range of 0.3 to 2.5 kcal/° C. , where |ΔHc| is a difference between a thermal conductivity of the exothermal inhibition material and a thermal conductivity of MgO.

7. The PDP of claim 6, wherein |ΔHc| is in the range of 1.5 to 2.5 kcal/° C.

8. The PDP of claim 5, wherein the exothermal inhibition material comprises $SiO_2$, $ZrSiO_4$, $ZrO_2$, or an Al compound.

9. The PDP of claim 5, wherein an amount of the exothermal inhibition material is in the range of 20–40 mol % with respect to an amount of MgO.

10. An exothermal inhibition layer for a plasma display panel, comprising an exothermal inhibition material that has an absolute value of ΔHc ("|ΔHc|") in the range of 0.3 to 2.5 kcal/° C., where |ΔHc| is a difference between a thermal conductivity of the exothermal inhibition material and a thermal conductivity of MgO, wherein the exothermal inhibition layer is formed on a dielectric layer either at a portion corresponding to a non-discharge region only or a portion corresponding to a discharge region only of the plasma display panel, the dielectric layer being arranged between the exothermal inhibition layer and a substrate of the plasma display panel.

11. The exothermal inhibition layer of claim 10, wherein $|\Delta Hc|$ is in the range of 1.5 to 2.5 kcal/° C.

12. The exothermal inhibition layer of claim 10, further comprising MgO.

13. The exothermal inhibition layer of claim 12, wherein an amount of the exothermal inhibition material is in the range of 20–40 mol % with respect to an amount of MgO.

14. The exothermal inhibition layer of claim 10, wherein the exothermal inhibition material comprises $SiO_2$, $ZrSiO_4$, $ZrO_2$, or an Al compound.

* * * * *